US008528794B2

(12) United States Patent
Wolf et al.

(10) Patent No.: US 8,528,794 B2
(45) Date of Patent: Sep. 10, 2013

(54) PRESSURIZED PACK FOR VISCOUS MATERIALS

(75) Inventors: Karsten Wolf, Pulheim (DE); Rene Schwarz, Krefeld (DE); Jan Ziegler, Frankfurt (DE); Kai Ruthe-Steinsiek, Duesseldorf (DE); Matthias Rhode, Kaarst (DE); Birgit Rhode, legal representative, Kaarst (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 240 days.

(21) Appl. No.: 12/757,501

(22) Filed: Apr. 9, 2010

(65) Prior Publication Data

US 2010/0237106 A1 Sep. 23, 2010

Related U.S. Application Data

(63) Continuation of application No. PCT/EP2008/063624, filed on Oct. 10, 2008.

(30) Foreign Application Priority Data

Oct. 12, 2007 (DE) ..... 10 2007 049 334

(51) Int. Cl.

| | |
|---|---|
| ***B65D 83/00*** | (2006.01) |
| ***A47G 19/00*** | (2006.01) |
| ***A47G 19/12*** | (2006.01) |
| ***B67D 3/00*** | (2006.01) |
| ***B67D 7/06*** | (2010.01) |

(52) U.S. Cl.
USPC ..... 222/402.15; 222/402.13; 222/402.21; 222/472; 222/505

(58) Field of Classification Search
USPC ..... 222/402.15, 310, 505, 402.11, 402.13, 222/402.21, 402.22, 402.23, 153.11, 472
See application file for complete search history.

(56) References Cited

U.S. PATENT DOCUMENTS 2,598,308 A * 5/1952 Samuels et al. ..... 222/43
3,534,890 A * 10/1970 Iannacone ..... 222/402.14

(Continued)

FOREIGN PATENT DOCUMENTS

DE 4303157 A1 8/1994
DE 60015798 T2 11/2005

(Continued)

OTHER PUBLICATIONS

International Search Report dated Feb. 23, 2009 for Application No. PCT/EP2008/063624.

*Primary Examiner* — Paul R Durand
*Assistant Examiner* — Matthew Lembo
(74) *Attorney, Agent, or Firm* — James E. Piotrowski; Steven C. Bauman

(57) ABSTRACT

The invention relates to a dispenser for dispensing an adhesive or sealant from a vessel, in particular from a pressurized vessel, via a valve. For this purpose, the dispenser is equipped with a lever with a grip region for actuating the valve. The dispenser also has an attachment, on which the lever is fitted in a pivotable manner, and an actuator with a supporting region for the lever. The actuator is configured such that it can be rotated relative to the attachment, and the supporting region is therefore variable, in order to change the effective lever path for the actuation of the valve, for activating or deactivating the dispenser or for varying the volume flow as product is dispensed.

18 Claims, 6 Drawing Sheets

(56) References Cited

U.S. PATENT DOCUMENTS

| | | | | |
|---|---|---|---|---|
| 3,782,605 | A * | 1/1974 | Messenger | 222/153.11 |
| 4,471,404 | A * | 9/1984 | Nitta | 361/247 |
| 4,735,346 | A * | 4/1988 | Stoody | 222/153.11 |
| 4,826,054 | A * | 5/1989 | Frutin | 222/402.11 |
| 5,027,986 | A * | 7/1991 | Heinzel et al. | 222/402.24 |
| 5,971,230 | A * | 10/1999 | Tanaka | 222/402.11 |
| 6,474,510 | B2 * | 11/2002 | Frutin | 222/153.11 |
| 6,494,349 | B1 * | 12/2002 | Thompson et al. | 222/402.15 |
| 6,685,064 | B2 * | 2/2004 | Frutin | 222/402.15 |
| 6,820,777 | B2 * | 11/2004 | Frutin | 222/402.15 |
| 7,044,341 | B2 * | 5/2006 | Sanchez | 222/404 |
| 7,140,515 | B2 * | 11/2006 | Cardwell et al. | 222/183 |
| 7,249,692 | B2 * | 7/2007 | Walters et al. | 222/153.11 |
| 7,641,079 | B2 * | 1/2010 | Lott et al. | 222/402.13 |
| 2006/0113327 | A1 | 6/2006 | Walters et al. | |
| 2007/0241134 | A1 * | 10/2007 | Gurrisi et al. | 222/153.11 |
| 2008/0230566 | A1 * | 9/2008 | Frutin | 222/402.15 |

FOREIGN PATENT DOCUMENTS

| | | | |
|---|---|---|---|
| EP | 1516830 | A1 | 3/2005 |
| WO | WO 2005082742 | A2 | 9/2005 |
| WO | WO 2005082743 | A2 * | 9/2005 |

* cited by examiner

PRESSURIZED PACK FOR VISCOUS MATERIALS

This application is a continuation of a national stage entry of PCT/EP2008/063624 filed Oct. 10, 2008, under the International Convention claiming priority over DE Application No. 102007049334.9 filed Oct. 12, 2007.

The invention relates to a dispenser for dispensing a product from a container reservoir, especially from a pressurized container. Viscous compounds, especially sealants and building products such as silicone-containing compounds or acrylic-containing compounds are dispensed for example with this kind of dispenser. Often these compounds are dispensed from a pressurized container containing a propellant gas by actuating a valve mechanism.

Many dispensers of this type are known from the prior art. DE 600 15 798 T2 discloses such a dispenser having a pressurized product chamber that contains the viscous material. A tilt valve, on which is sealed a rotatable nozzle arrangement with a nozzle, is provided on the product chamber. A pivotable lever adjoined to the product chamber and actioned by the force of the user acts in such a way on the nozzle arrangement so that this opens the tilt valve in order to dispense the viscous material. The nozzle arrangement can be rotated relative to its longitudinal axis and to the lever. This causes a change in the seating surface of the lever. This change either leads to an open position of the dispenser in which the application of force onto the lever enables material to be dispensed through the valve, or to a closed position, in which it is not possible for material to be dispensed.

This system has many disadvantages. For example there is only one possible choice between an open and a closed position of the nozzle arrangement. An adjustment of the product flow through the nozzle arrangement is not provided. Another disadvantage is the complicated construction of the system and the consequentially associated high production costs. Furthermore, the system can be activated or deactivated by turning the nozzle arrangement 90° in relation to the lever and the product chamber. A user cannot easily accomplish this, particularly the first time. Another major disadvantage is the impossibility to use such a dispenser with only one hand. In each case the user has to take the product chamber with one hand and turn the nozzle arrangement with the other hand in order to activate the dispenser, such that a totally one handed operation is not possible. A further disadvantage is that the nozzle belongs to the nozzle arrangement and thereby to the release mechanism. A nozzle change or cleaning is not provided for. Moreover the user can injure himself by being pinched in the components, such as for example the lever and the nozzle arrangement, which engage with one another when operated. Safe operation cannot be guaranteed with a system of this kind.

Accordingly, the object of the invention is to provide an improved dispenser that avoids the abovementioned disadvantages and in particular ensures an improved adjustment of the product flow.

This object is achieved by means of the features of claim 1.

The advantageous developments of the invention are indicated with the dependent claims.

The basic idea of the invention consists in employing a dispenser for dispensing a product, said dispenser consisting of a vessel with a vessel axis, a valve, a nozzle connected by a connecting means to the valve, an attachment, a lever with a grip region for the user and an actuator with a supporting region, which provides an engagement point for the lever, wherein the lever, for actuating the valve over the engagement point, can be pivoted about an axis that is fixed with respect to the attachment, wherein said actuator is configured such that it can be rotated relative to the lever, to the attachment and to the nozzle about the vessel axis, such that the engagement point for the lever can be moved axially with respect to the vessel axis in order to change the effective lever path for the actuation of the valve.

An essentially cylindrical vessel is preferably used. In this regard, the valve is preferably arranged coaxially with the longitudinal axis of the cylindrical vessel and on the vessel and communicates with the cavity of the vessel. The attachment is provided on the same side of the vessel as the valve and is firmly connected with the vessel in such a way that an axial displacement of the attachment relative to the longitudinal axis of the vessel is impossible. The attachment possesses a mounting facility with an axis of rotation so that the lever can be rotated. In this regard, the lever is preferably designed in such a way that on the one side it possesses the area that the user grips, and on the other side is pivotably arranged on the attachment. Here the valve is arranged on the vessel between the mounting of the lever and the gripping area. By pivoting the lever the user can exert force through the actuator onto the valve and open it in order to dispense product out of the vessel. A support area is provided for this on the actuator and provides engagement points for the lever in order to transmit the force applied by the user. The valve preferably has a radially extending flange or similar transmission means, such that the force applied by the user can be transmitted over the lever and the actuator onto the valve. The force applied by the user presses the valve towards the vessel until it opens. In this way product can be dispensed out of the vessel. The effective lever path here is the path about which the lever displaces the valve. With a sufficient lever path, the valve opens and the material in the vessel is dispensed. Due to the rotatable mounting of the actuator, preferably in relation to the vessel axis, and a correspondingly designed supporting area, engagement points that are changed by a rotation of the actuator are made available to the lever. The supporting area is designed such that the engagement points made available by the supporting area for the lever are displaced axially with respect to the vessel axis by a rotation of the actuator. In this way, the rotatability of the actuator provides variable engagement points over the supporting area. Because of the fixed pivotable mounting of the lever on the attachment, an axial displacement of the engagement points effects a rotation of the lever through the rotation of the actuator, whereby the effective lever path for actuating the valve through the lever can be varied. The lever that can be employed is preferably curved. In this regard, the gripping area of the lever in the non-operative mode, in which no product can be dispensed through the valve, can preferably run essentially parallel to the vessel axis. In this case, the lever and/or the gripping area preferably rest against the external wall of the vessel. In this non-operative position a force is preferably not exerted on the valve. This type of construction has the advantage of providing a good lever action to the user, who can operate the dispenser with little effort. At the same time the dispenser takes up little space; this is not only advantageous for storage at the user but also in production and in storage in the showroom. At the level of the valve above the vessel, the lever runs essentially orthogonally to the vessel axis curved to the gripping area.

The supporting area of the actuator that is preferably used is designed such that a first non-operative position is provided for the lever which corresponds to the above described non-operative position of the lever. By rotating the actuator relative to the attachment and thereby to the lever that is connected to the attachment, the engagement points of the lever, depending on the design of the supporting area of the actuator, can be moved axially in relation to the axis of the vessel towards the vessel. This displacement of the engagement point of the lever effects a tilting or pivoting of the lever about the pivotable mounting on the attachment. Due to the preferably curved construction shape of the lever the angle between the gripping area of the lever and the external wall of the vessel will be enlarged by this pivoting of the lever. Thus, rotating the actuator relative to the attachment can change the angle between gripping area and external wall of the vessel. As soon as the gripping zone no longer touches, the user can exert force on it thereby leading to a movement of the gripping area towards the external wall of the vessel. Due to the above described curved type of construction of the lever, the lever produces a force acting through the engagement points of the actuator onto the valve and presses the valve towards the vessel. In this regard, the effective lever path of the lever is the path the lever takes to press the valve towards the vessel. In the preferred type of construction it is all the greater, the greater the angle between gripping area and external wall of the vessel.

This type of construction of a dispenser has the following advantages. The whole system can be deactivated due to the adjustable engagement points for the lever, in that an inadequately effective lever path is procured for opening the valve. Thus for example an inadvertent discharge of product is avoided. The above described arrangement of the supporting facility on the opposite side of the gripping area ensures an ergonomic handling for the user. Generally, this type of dispenser is operated with one hand. For this the user grips the dispenser with the hand such that the thumb and fingers enclose the vessel. This grip ensures a safe manipulation of the dispenser when applying the product. The product is dispensed either through the action of the finger or of the thumb on the gripping area of the lever. The actuator can be very easily rotated relative to the attachment by the user by means of one or more fingers of the same hand. This discloses an essential advantage of the apparatus, the one-handed operation. Gripping the dispenser not only enables the user to activate and deactivate the dispenser. Rather it also enables for example a regulation of the volume flow as the material is dispensed through the adjustable engaging point by the actuator. Accordingly, it is conceivable for example that the user grips the system as described above, activates the system using the actuator, applies force to the gripping area of the lever, and thereby dispenses the material. Should the user need a higher or lower volumetric flow during the material application then he can regulate this by rotating the actuator during the application procedure. Interrupting the application and consequently breaking off the product bead on the substrate are not necessary. Nonetheless the one-handed operation facility ensures that the user can use his other hand for adjustment work or additional tools. It also enables the user to safeguard himself with his free hand, for example onto a ladder or scaffolding, as are often to be found on construction sites, thereby avoiding possible workplace accidents.

In order to simplify the rotation of the actuator when working with an inventive dispenser, it has proven advantageous to provide an adjustment means for rotating the actuator. This preferably protrudes out of the overall assembly and provides a good gripping facility to the user. This ensures that the actuator can be easily rotated. Suitable handgrip recesses or non-slip elements can be provided on the adjustment means to facilitate this.

A further advantage is the use of an attachment that is connected to the vessel, wherein the attachment in some areas surrounds the protruding part of the valve of the vessel with a side wall, wherein openings are provided in the side wall for the lever and/or for operating the actuator. This side wall protects the valve together with the moving parts and especially the force transmission mechanism of the dispenser against external influences. Moreover it prevents the user from jamming and injuring himself when working, because the force-transmitting component areas and those that connect with one another during the work, such as for example the lever and the actuator as well as the valve, are covered by the side wall of the attachment. In this regard it is advantageous to use a cap that can be connected to the attachment. The cap provides further protection, in that it covers the valve and the transmission mechanism in addition to the side wall of the attachment. Here, the cap preferably possesses an opening, through which can be fed for example, a nozzle for dispensing the material, and which can be connected to the valve. The side wall preferably surrounds the valve in such a way that only one opening is provided, though which the lever protrudes. Thus, the user can exert force over the gripping area of the lever, which protrudes through the space enclosed by the side wall of the cap, onto the valve for dispensing the product out of the vessel. Another embodiment provides an additional opening in the side wall for operating the actuator. A similar opening is also conceivable, wherein only one adjustment means provided on the actuator protrudes through it for facilitating the rotation. In this regard the opening in the side wall is preferably provided in the form of a slit in the direction of rotation of the actuator such that a rotation can be made without difficulty.

In order to facilitate the rotation of the actuator for the user, it is considered advantageous to provide one or a plurality of arresters on the attachment which limit the rotation of the actuator. For example the user can be provided with a start and an end point, from or to which the actuator can be rotated. Another advantage is the use of snap-in points on the attachment which represent individual rotational segments for the actuator. Here predetermined matching engagement points can be provided to the user on the supporting area and for example to the material to be dispensed, and which are attained for a specific rotational angle of the actuator relative to the attachment. The user thus receives a dispenser that is easy to operate because presettings for possible quantities of discharged product are provided by the snap-in points.

In order to ensure a secure mounting of the lever it is considered advantageous to equip the attachment with supports, on which the lever is pivotably mounted. In this regard the supports on the attachment preferably protrude away from the vessel essentially parallel to the vessel axis. Preferably two supports opposite one another are provided, wherein the lever is mounted between the supports. Here the supports can have openings, into which engage corresponding protrusions of the lever in order to ensure a pivotable mounting. A reverse constructional type is of course possible, in which the supports have protrusions facing the lever and which engage into openings in the lever. The use of a separate axle that runs through holes through the supports as well as the lever is also conceivable.

Another advantage is the use of a lever that surrounds the valve, wherein pressure areas are molded on the lever in order to hold the lever on the engagement points on the supporting area. The molded and preferably protruding pressure areas permit a secure grip of the lever on the engagement points and ensure a secure transmission of force when operating the dispenser and when discharging the product. Preferably the lever has an opening, through which the valve is lead. Here the pressure areas can be formed opposite to each other on both sides of the valve. This ensures a good transmission of force from the lever onto the valve.

Another advantage when using a lever with molded pressure areas is a type of dispenser construction such that the line of engagement that runs through the engagement points of the pressure areas of the lever on the support area runs essentially parallel to the rotational axis of the lever. This type of construction prevents any torsion of the lever when the user exerts force during product discharge. In this way a dispenser with higher strength and therefore for safer and more reliable working is made available. When force is exerted for actuating the valve, the part of the lever opposite the gripping area is supported over the pivotal mounting for example on the supports of the attachment. The force thereby acts essentially away from the vessel. Because the engagement line runs parallel to the rotational axis, both mounting points, for example both supports of the attachment, are acted upon with the same force. If the engagement line were to run divergently, then one mounting point of the lever would be more heavily loaded and for example would be damaged by material fatigue. This would result in irreparable damage and breakdown of the dispenser.

A further advantage is the use of an actuator that possesses an opening, through which the valve runs. Here, the actuator is designed in such a way that it encloses the valve. In many cases valves are used that have a hollow cylindrical outlet channel. In such a case a peripheral collar protruding from the outer surface is mostly provided over which force can be exerted onto the valve for discharging the product. A good transmission of force can be exerted onto a large area of the protruding collar by using an actuator with an opening, through which the valve runs.

A further advantage when using an actuator with an opening, through which the valve runs, is the outfitting of the valve with connecting means in order for example to fasten a nozzle or another additional component on the valve for discharging the product present in the vessel, wherein the opening of the actuator is dimensioned in such a way that the actuator does not engage with the nozzle or the other additional component. This has the advantage that a rotation of the actuator does not cause the nozzle to rotate. Angled nozzles are used in many applications. If the user were to rotate the actuator that engaged with the nozzle then the nozzle would be turned into an unfavourable position for the user and the product discharge. This is avoided by preventing the actuator and the nozzle to mesh. Moreover the actuator and the nozzle are prevented from tilting, which would result in the impossibility of turning the actuator or changing the nozzle.

Another advantage is the use of an actuator with an opening, wherein relative to the opening, at least two opposite supporting areas for the lever are provided and which are arranged essentially partly circularly about the rotational axis of the actuator. These supporting areas are preferably arranged near to the opening, through which the valve runs. In this way two opposite engagement points, relative to the opening, are provided to the lever. A one-sided loading of the actuator and consequently a one-sided force acting on the valve prevents any possible tilting or obstruction of the components. The invention is described below in more detail for an embodiment that is illustrated in the drawings:

Figure 1:
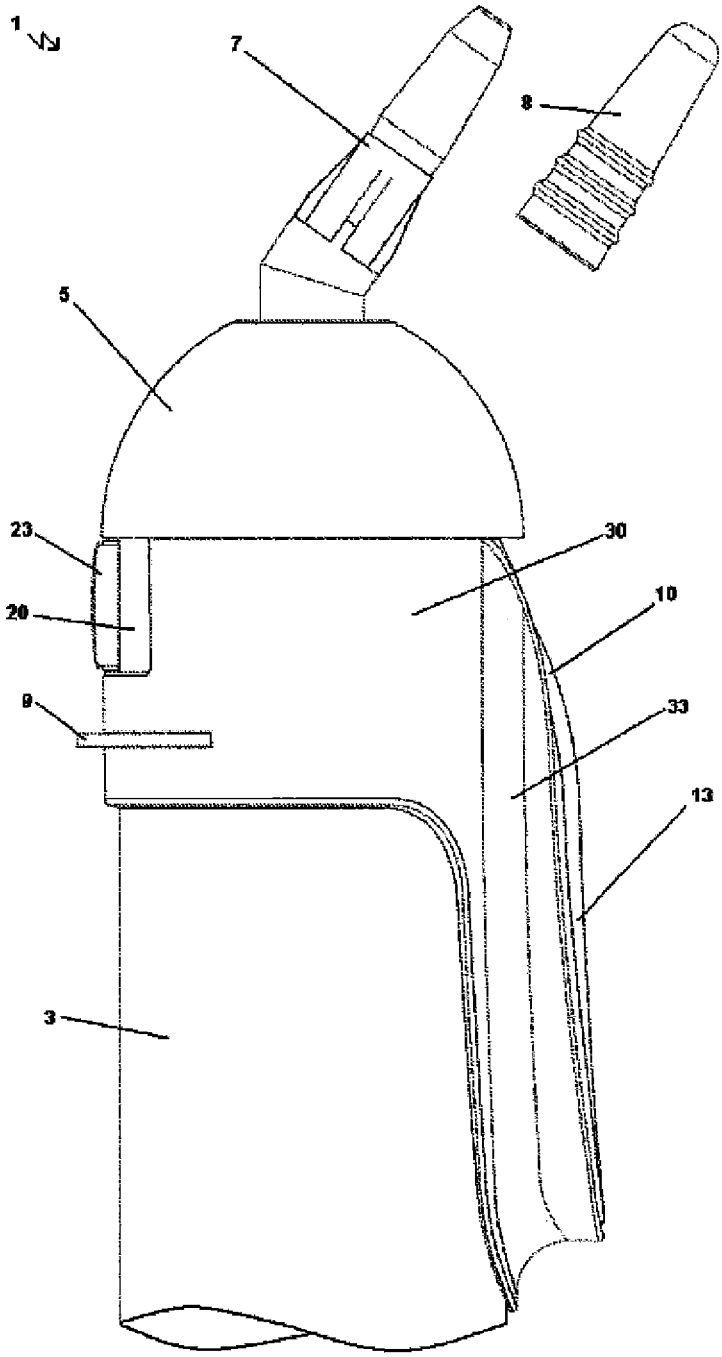
FIG. 1 shows a side view of an inventive dispenser.

FIGS. 1-6 show an inventive dispenser 1 for dispensing a product from a cylindrical vessel 3 having a vessel axis 4. In the present case the vessel 3 is configured as a pressure vessel. Suitable materials for this construction are for example metals, such as aluminum or tinplate. Other suitable materials can of course also be used. With the vessel 3 there is provided a valve 2 for dispensing the product present in the vessel 3 through a nozzle 7. In addition, the nozzle 7 can be connected through connecting means 6 to the side of the valve 2 that faces away from the vessel 3. The discharge opening of the nozzle 7 can be covered by a cap 8 so as to protect the nozzle 7 and the valve 2 from contamination.

In the present embodiment, a tilt valve, known from the prior art, is used as the valve 2. A valve 2 of this type is generally known in dispensers 1 and functions by tilting a hollow central spindle that is elastically held on an assembly shell by a rubber grommet. The spindle is closed on its lower end by a sealing plate. When the spindle is tilted, the seal between the grommet and the sealing plate is broken and the product present in the vessel 3 can attain channels in the central spindle and then flow along the hollow spindle.

The valve 2 used here which is not directly connected to the nozzle 7 that is used, has proved to be particularly advantageous. Finally, an additional component can be fastened through said connecting piece 6, such as for example a screw connection or snap-on connection, on the valve outlet, on which the product is dispensed. This division into two components has the advantage that different nozzles 7 appropriate to the application case can be used. Also the nozzle 7, after use, can be removed for cleaning, with the result that the dispenser 1 can be used many times and does not need to be disposed of after a single use after the product has hardened up in the nozzle 7.

When using the dispenser 1, if the valve 2 is pressed towards the vessel 3 or tilted, then it opens and the product present in the vessel 3 can be dispensed. For this, the dispenser illustrated in FIG. 1 has a lever 10 that interacts with the valve (not shown). The valve is covered by an attachment 30 and protected against external influences. The attachment 30 is firmly connected to the vessel 3. The connection can be produced by means of a snap connection for example or by other types of connections known to the person skilled in the art. A connection through a bracket 9 that engages into a corresponding recess on the vessel 3 is also conceivable. This would have the advantage that an exhausted vessel 3 can be exchanged for a new one, wherein the sub-assembly for dosing and discharge of the product can continue to be used. Furthermore, means (not shown) can be provided on the attachment 30, for example protruding pins or spring elements, which fix or secure the lever 10 into its respective position to the vessel 3, so as to avoid any unwanted movement or flapping of the lever, for example during transportation. This can be realized by applying a spring force, for example. The attachment 30 completely encloses the valve up to an opening from which protrudes the lever 10 and an additional opening opposite the first. The latter serves for turning an actuator 20. For facilitating the operation a protruding adjustment means 23 is provided on the actuator and offers the user a good gripping facility. The actuator 20 can be rotated about an axis, which in the present embodiment corresponds to the longitudinal axis of the cylindrical vessel 3.

Rotating the actuator 20 changes the effective lever path of the lever 10 for operating the valve. In this way a possibility is provided for the actuator 20 to activate or deactivate the dispenser 1 by varying the effective lever path of the lever 10, or to vary the possible volumetric flow during he product discharge. In order to make the work with the dispenser 1 easier for the user, the part of the lever 10 that protrudes out of the opening of the attachment 30 runs essentially parallel to the external wall of the vessel 3. In this way little space is required. The illustrated dispenser 1 is in the non-operating position, i.e. it has been deactivated by the actuator 20. In this position the lever 10 preferably rests on the external wall of the vessel 3. So as to avoid pinching oneself when working, the attachment 30 has a cover 33 that partially encloses the area of the lever 10 that sticks out from the external wall of the vessel 3. The lever 10 also has a gripping area 13 for the user on which the user preferably exerts force on the lever 10 for discharging product. This can be additionally equipped with hand grip recesses or non-slip elements. For a further protection of the valve and the force transmission mechanism, the dispenser 1, in addition to the attachment 30, is equipped with a cap 5 that is connected to the attachment 30.

Figure 2:
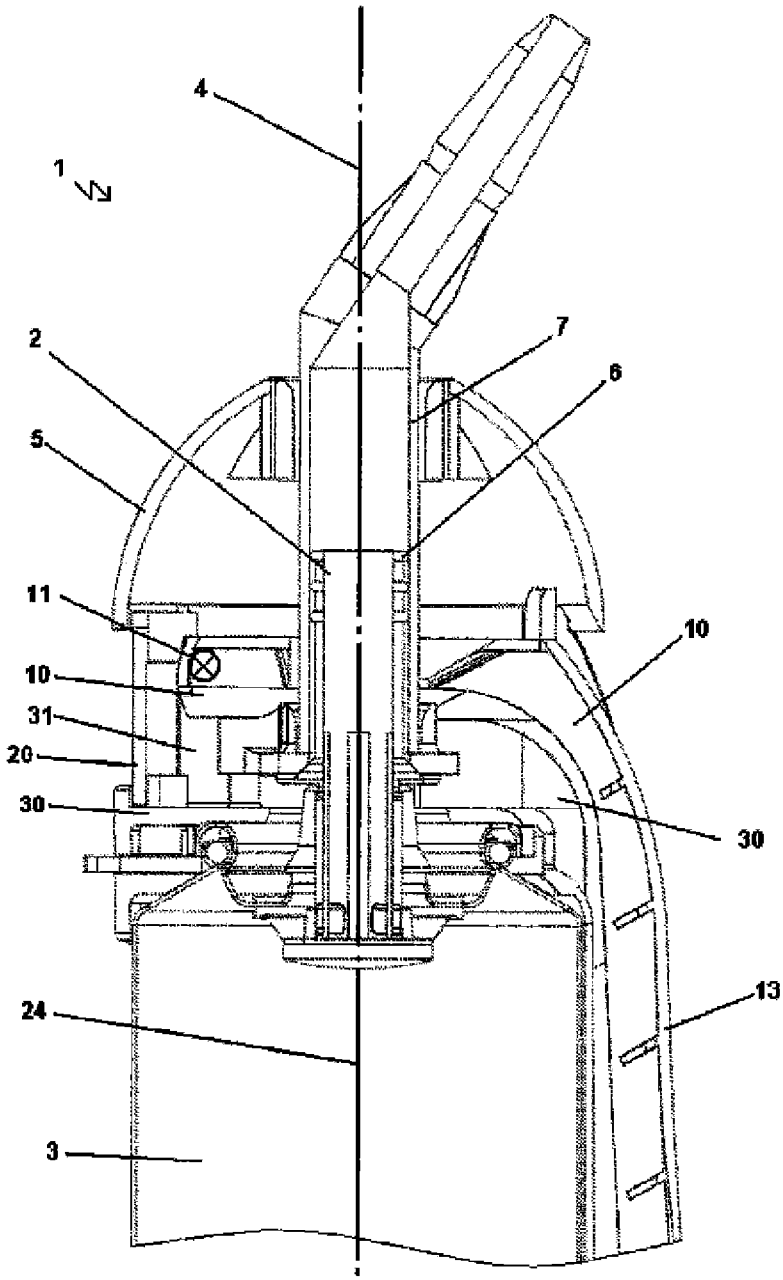
FIG. 2 shows a cross sectional side view of the inventive dispenser of FIG. 1.

FIG. 2 shows a cross sectional side view of the dispenser of FIG. 1. The attachment 30 that is firmly connected to the vessel 3 has supports 31, on which the lever 10 is pivotably mounted about an axis 11. For varying the effective lever path of the lever 10, the actuator 20 can be twisted around the longitudinal axis 4 of the vessel, the rotational axis 24. The actuator 20 has an opening, through which runs the valve 2. The opening is dimensioned in such a way that the actuator 20 rests on an outwardly protruding collar of the valve 2 and can transmit force onto it. Naturally, instead of the collar, other force transmitting possibilities are conceivable. Just as the actuator 20, the lever 10 also has an opening, through which runs the valve 2. In this regard, the lever 10 is configured in such a way that the actuator 20 is located between the lever 10 and the collar of the valve 2. To operate the valve 2, the user exerts force on the gripping area 13 of the lever 10 lying outside the attachment 30 and pivots it about the axis 11. The lever thereupon presses onto the actuator 20 that once again transmits the acting force over the collar of the valve 2 onto the valve. This application of force presses the valve 2 towards vessel 3 until the valve 2 opens and product can be discharged out of the vessel 3 over the valve 2. For a more precise metering of the product, a nozzle 7 is provided that is connected through connection means 6 to the valve 2 and protrudes out of an opening of the cap 5 from the space enclosed by the cap 5 and the attachment 30 and protected from external influences. The pivotability of the lever 10 about the axis 11 for operating the valve 2 is limited by means of an arrester. In the present embodiment, the external wall of the vessel 3 represents the arrester for the bent part of the lever 10 with the gripping area 13. Of course, other arresters for the lever 10 are also conceivable. The lever can be pivoted so far about the axis 11 until the lever 10 rests against the external wall of the vessel 3. In the present embodiment, the lever 10 already rests on the external wall of the vessel 3, such that a rotation of the lever 10 in order to operate the valve 2 is not possible. The dispenser 1 is thereby in the non-operative position and cannot be actuated. In order to activate the dispenser 1, the lever 10 must be rotated about the rotational axis 11, such that the distance between the lever 10 and the arrester from the vessel 3 is increased. The actuator 20 is provided for this. The magnitude of the force-transmitting part of the actuator 20 between lever 10 and collar of the valve 2 can be varied by rotating the actuator 20 about the axis 24. By increasing this part by rotating the actuator 20, the lever 10 in the region of the constraint is shifted on the actuator 20 in the opposing direction relative to the vessel 3. This leads to a rotation of the lever 10 about the rotational axis 11, wherein the angle between the bent part of the lever 10 with the gripping area 13 and the external wall of the vessel 3 is increased and thereby the distance is increased between the lever 10 and the arrester, the external wall of the vessel 3. As a result, the user can exert force on the gripping area 13, can thereby rotate the lever 10 about the rotational axis 11 and thus exert force over the actuator 20 onto the valve 2 so as to discharge the product. Therefore, through the actuator 20 a change of the effective lever path is possible in order to operate the valve 2 through the lever 10. By rotating the actuator and a thereby linked increase or decrease of the force-transmitting part of the actuator 20 between lever 10 and collar of the valve 2, the user can activate, deactivate the system or vary the possible volumetric flow during the product discharge.

Figure 3:
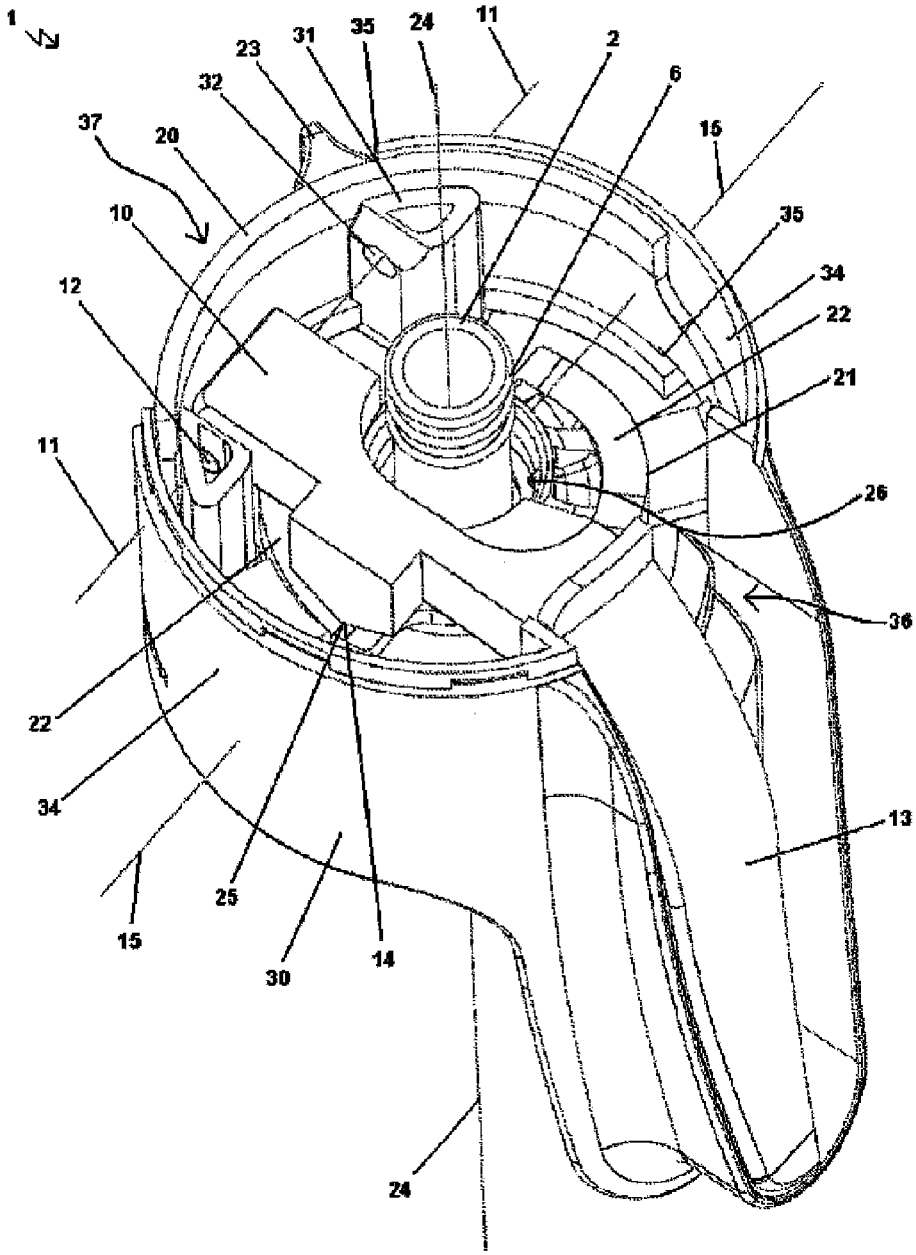
FIG. 3 shows a perspective view of a sub-assembly of the inventive dispenser of FIG. 1.

The perspective view of a sub-assembly of the dispenser of FIG. 1 illustrated in FIG. 3 shows the attachment 30 with both of the supports 31. The supports 31 protrude from the base of the attachment 30 in the opposite direction in relation to the vessel (not shown) essentially parallel to the valve 2. The one side of the lever 10 is arranged between both of the supports. The supports 31 have mounting positions 32 facing the lever 10 which are configured as a borehole, in which corresponding, essentially cylindrical lugs 12 of the lever engage. Through the connection that is formed by the mounting positions 32 and the lugs 12, the lever 10 can be rotated about the axis 11 relative to the attachment 30. The lever 10 surrounds the valve 2 and possesses the curved area with the gripping region 13 on the side opposite the mounting on the attachment 30. This side juts out of an opening 36 from the attachment 30 and is thereby easily accessible to the user. The attachment 30 possesses a side wall 34, which essentially surrounds the valve 2 and the force-transmission mechanism for activating the valve 2, and thereby protects against damage and contamination. In addition to the opening 36 for the lever 10, the attachment 30 possesses a further opening 38 for the actuator 20 in the region of the side wall 34. With this opening 38, the user can rotate the actuator 20 about the axis 24 so as to vary the effective lever path. For this, the user is provided with the adjustment means 23 that offers a good gripping facility. In order to limit the rotational path of the actuator 20, arresters 35 are provided on the attachment 30 or on the side wall 34 of the attachment 30. These arresters 35 interact with areas of the actuator 20 or of the adjustment means 23 and thereby prevent any rotation of the actuator 20 further than a predefined angle. The actuator 20 has a valve opening 26, through which the valve 2 is lead. The valve 2 can be equipped over the connection means 6 with a nozzle (not shown). In this regard, the opening 26 of the actuator 20 is dimensioned in such a way that the nozzle does not engage with the actuator 20. This prevents the nozzle from being rotated with the actuator 20 when the actuator 20 is rotated about the axis 24. In the area of the opening 26, the actuator 20 possesses two oppositely placed supporting areas 22 for the lever 10. These supporting areas 22 are arranged essentially semi-circularly about the rotational axis 24 of the actuator 20 on said actuator. The supporting areas 22 provide, depending on the rotation of the actuator 20, various engagement points 25 for the lever 10 for exerting force through the actuator 20 onto the valve 2. The supporting areas 22 are here provided on positional ramps 21. This results in that the possible engagement points 25 for the lever 10 vary over the semi-circular supporting areas 22 when the actuator 20 is rotated depending on the changing height along the positional ramp 21. Here, the change is a variation of the position of the engagement points 25 in relation to the longitudinal axis of the vessel. In other words, by rotating the actuator 20, the force of the actuator 20 between the valve 2 and the effective range of the lever 10 varies along the positional ramp 21. This change causes the lever 10 to pivot about the pivotal axis 11, thereby varying the effective lever path of the lever 10 in order to activate the valve 2. In order to transfer the force exerted by the user over the lever 10 onto the actuator 20 and thereby onto the valve 2, the lever 10 possesses molded pressure areas 14 in the region of the opening, through which runs the valve 2. The lever 10 is supported over these pressure areas 14 on the engagement points 25 on the supporting areas 22. In this regard, the pressure areas 14 are designed such that the engagement line 15 that runs through each of the engagement points 25 that interact with the pressure areas 14 of the support area 22, runs essentially parallel to the rotational axis 11 of the lever 10. Of course, in addition to the illustrated assembly, further embodiments are also conceivable. In particular, it is conceivable to subdivide the actuator 20 in a plurality of components. Accordingly, in a further embodiment, a sub-assembly can be conceived for example as the actuator 20, wherein a component of the sub-assembly includes the supporting area 22 and another component that interacts with the first provides a rotation facility for the user. This separation especially has the advantage that for a displacement of the actuator 20 onto the valve 2 effected by the action of force by the user, the rotation possibility of the actuator 20 would not be moved towards the vessel.

Figure 4:
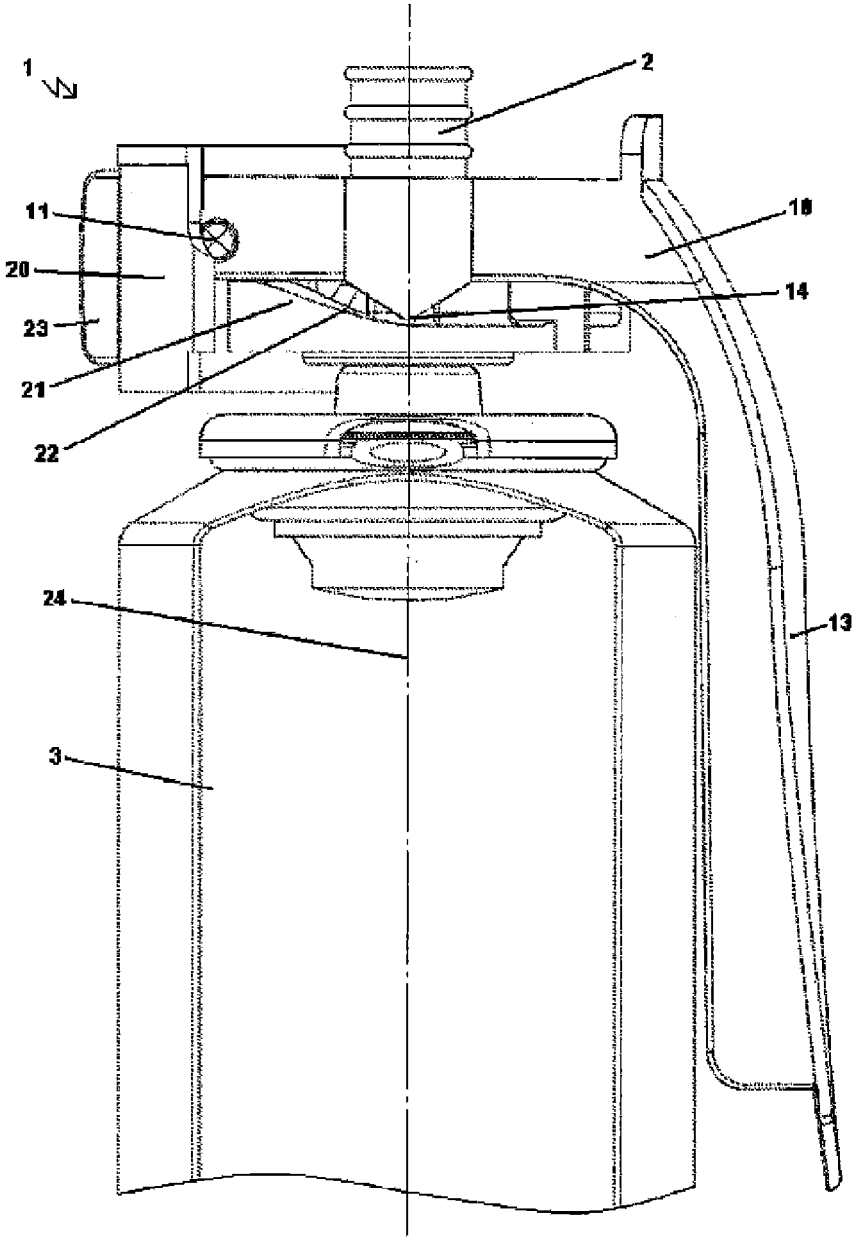
FIG. 4 shows a cross sectional side view of a sub-assembly of the dispenser of FIG. 1 in the non-operating position.
Figure 5:
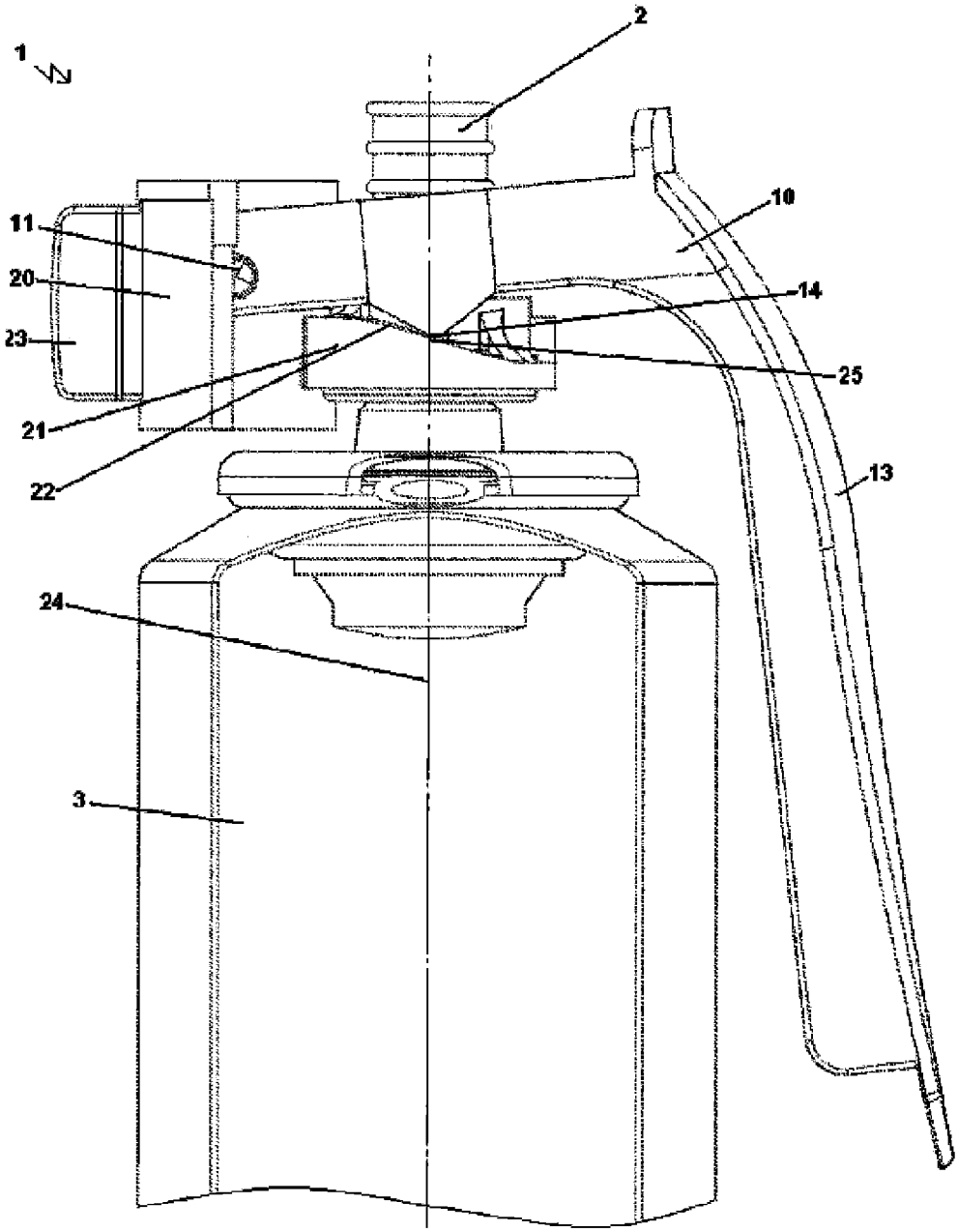
FIG. 5 shows a cross sectional side view of a sub-assembly of the dispenser of FIG. 1 in the operating position for a normal product discharge.
Figure 6:
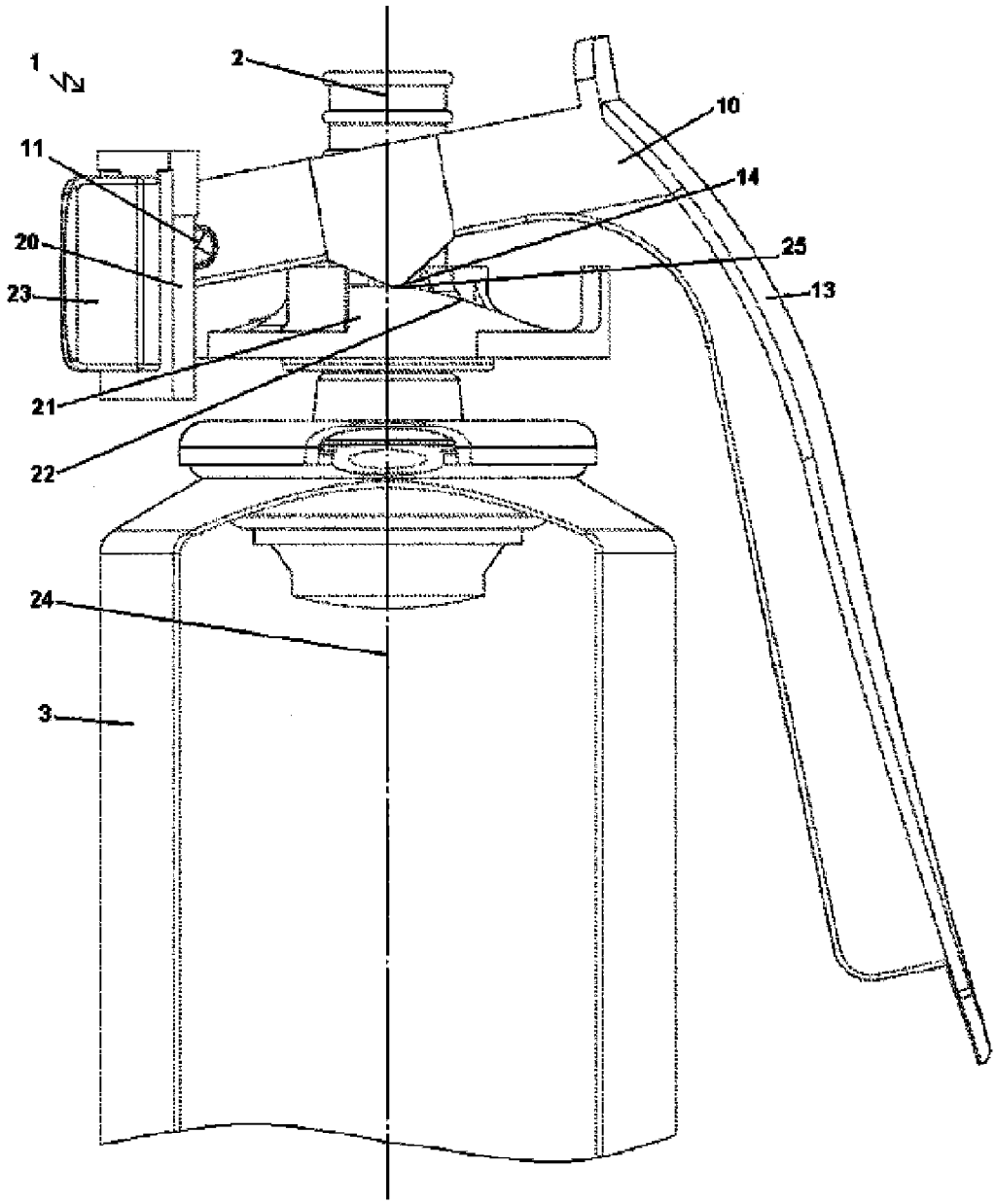
FIG. 6 shows a cross sectional side view of a sub-assembly of the dispenser of FIG. 1 in the operating position for a higher product discharge.

The FIGS. 4, 5 and 6 show cross sectional side views of the dispenser 1, wherein in order to increase the clarity in the illustration, some components, such as for example the attachment, have not been shown. The dispenser 1 is shown in the non-operating position, in the activated position and in the activated position for higher discharge of product.

FIG. 4 shows the dispenser 1 in the non-operating position. In this position the area of the lever 10 with the gripping area 13 rests on the external wall of the vessel 3 such that the lever 10 cannot rotate about the axis 11 and thereby no force can be exerted through the lever 10 onto the valve 2. In this position no effective lever path is available for operating the valve 2. For this the actuator 20 has been rotated through the adjustment means 23 in such a way about the axis 24 that the supporting area 22 is found in such a position on the positional ramp 21 that no engagement point is available to the pressure area 14 of the lever 10.

FIG. 5 shows the dispenser 1 in the operating position. Here, the actuator 20 has been rotated through the adjustment means 23 about the axis 24 in such a way that an engagement point 25 on the supporting area 22 on the positional ramp 21 is available to the lever 10. Due to the positional ramp 21 the lever 10, during the rotation of the actuator 20, has been displaced along the supporting area 22 towards the product discharge side of the valve 2. This results in a rotational movement of the lever 10 about the axis 11, thereby increasing the angle between the region of the lever 10 with the gripping area 13 and the external wall of the vessel 3. The user can now exert force on the gripping area 13 towards the vessel 3 and pivot the lever 10 about the axis 11. Consequently the force exerted by the user would be transferred over the pressure area 14 of the lever 10 onto the engagement point 25 and thus onto the valve 2, thereby causing the valve 2 to move towards the vessel 3. In the operational position of the dispenser 1, a sufficiently effective lever path for operating the valve 2 is provided for discharging the product.

FIG. 6 shows the dispenser 1 in the operational position for increased product discharge. For this the actuator 20 has been further rotated by the adjuster means 23 about the axis 24 when compared with the position of the actuator 20 of the dispenser 1 in FIG. 5. In this regard, the lever 10, during the rotation of the actuator 20, has been displaced further along the supporting area 22 towards the product discharge side of the valve 2. This renewed rotational movement of the lever 10 about the axis 11, leads to a greater angle between the region of the lever 10 with the gripping area 13 and the external wall of the vessel 3. The user in this case can also exert force onto the gripping area 13 towards the vessel 3 and pivot the lever 10 about the axis 11.

Consequently the force exerted by the user would be transferred over the pressure area 14 of the lever 10 onto the engagement point 25 and thus onto the valve 2, thereby causing the valve 2 to move towards the vessel 3. In the operational position of the dispenser 1, not only a sufficiently effective lever path for operating the valve 2 is provided for discharging the product. Rather the valve 2 can be pressed towards the vessel in such a way that allows the product to be discharged with an increased volumetric flow.

In addition to the illustrated examples, intermediate steps are of course also possible when rotating the actuator 20, such that the user can steplessly vary the effective lever path. Moreover, it is also possible to use a positional ramp 21 that subdivides the supporting area 22 into different steps. Consequently, the user has been provided with a dispenser 1 that includes predefined, preferably preset flow rates and flow rates that are matched to the product and/or the nozzle geometry during the product discharge. These steps represent specific effective lever paths of the lever 10 for operating the valve 2 through the lever 10. It is conceivable here to use two steps for a non-operational position and an operating position. This is particularly sensible for the lay public and beginners, who would be overwhelmed by trying to regulate the volumetric flow of the product. By incorporating additional steps for advanced learners and professionals, such as for example tradesmen, then additional effective lever paths can be made available, such that the volumetric flow can be matched to the specific requirements. The positional ramps 21 can also be asymmetrically designed. This can mean for example that the supporting areas 22 of both positional ramps 21 are subdivided into steps, but the steps of the supporting area 22 of one positional ramp 21 are chamfered, the steps of the supporting area 22 of the second positional ramp 21 being sharp edged. By using an actuator 20 with this type of positional ramp 21 then the lever 10 can slip easily away over the individual chamfered steps of the first supporting area 22. The sharp edged steps of the other supporting area 22 enable the lever 10 to sit securely and enable a secure exertion of force through the lever 10 onto the valve 2.

LIST OF REFERENCE NUMERALS

1 Dispenser
2 Valve
3 Vessel
4 Longitudinal axis
5 Cap
6 Connection means
7 Nozzle
8 Cap
9 Bracket
10 Lever
11 Rotational axis of the lever
12 Projection
13 Gripping area
14 Pressure area

15 Engagement line
20 Actuator
21 Positional ramp
22 Supporting area
23 Adjustment means
24 Rotational axis of the actuator
25 Engagement point
26 Opening
30 Attachment
31 Support
32 Mounting point
33 Cover
34 Side wall
35 Arrester
37 Lever opening
38 Opening

The invention claimed is:

1. A dispenser for dispensing a product, said dispenser consisting of:

a vessel with a vessel axis;

a valve having a range of positions from closed to open;

a nozzle connected by a connecting means to the valve;

an attachment;

a lever with a grip region for a user;

an actuator with a supporting region comprising a ramp extending helically around a portion of the valve, and a variable engagement point for the lever;

wherein the engagement point is provided along the ramp on the actuator;

wherein said actuator can be rotated relative to the lever, to the attachment and to the nozzle about the vessel axis, thereby displacing the engagement point axially along the vessel axis, causing the lever to pivot away from the vessel axis about a lever axis that is fixed with respect to the attachment;

and wherein pivotal movement of the lever around the lever axis towards the vessel axis displaces the supporting region axially with respect to the vessel axis, thereby selectively opening the valve.

2. The dispenser according to claim 1, wherein an adjustment means is provided for rotating the actuator.

3. The dispenser according to claim 1, wherein the attachment in some areas surrounds a protruding portion of the valve of the vessel with a side wall, wherein openings are provided in the side wall for the lever and/or for operating the actuator.

4. The dispenser according to claim 1, wherein the attachment has arresters that limit the rotation of the actuator.

5. The dispenser according to claim 1, wherein the attachment has supports, on which the lever is pivotably mounted about the lever axis.

6. The dispenser according to claim 1, wherein the lever surrounds the valve, pressure areas are molded to the lever in order to support the lever on the supporting region.

7. The dispenser according to claim 6, wherein the engagement line that runs through the engagement point of the pressure area on the supporting region, runs essentially parallel to the rotational axis of the lever.

8. The dispenser according to claim 1, wherein the actuator has an opening, through which runs the valve.

9. The dispenser according to claim 8, wherein the valve has connection means in order to fasten the nozzle to the valve for dispensing the product present in the vessel, and the opening of the actuator is dimensioned such that the actuator does not engage with the nozzle.

10. The dispenser according to claim 8, wherein the actuator with respect to the opening has at least two opposite support areas for the lever which are arranged essentially semi-circularly about the rotational axis of the actuator.

11. The dispenser according to claim 1, wherein the valve is concentric with the vessel axis.

12. The dispenser according to claim 1, wherein the valve remains concentric with the vessel axis when the lever is pivoted about the lever axis.

13. The dispenser according to claim 1, wherein the actuator comprises a ramp of varying axial thickness extending helically around a portion of the vessel axis, a surface of the ramp defining an engagement point.

14. The dispenser according to claim 13, wherein the ramp surface is stepless.

15. The dispenser according to claim 13, wherein the ramp surface comprises steps.

16. The dispenser according to claim 1, wherein the valve is not rotated upon rotation of the actuator.

17. A dispenser for dispensing a product from a pressurized vessel having a vessel axis and a valve having a range of positions from closed to open, comprising:

a nozzle connectable to the valve, an attachment to hold the dispenser to the vessel;

an actuator having a first surface positionable in contact with the valve and an opposing, axially spaced second surface defining a ramp extending helically around a portion of the valve; the actuator user rotatable around the vessel axis without rotation of the attachment or the nozzle;

a lever fixed to the attachment for pivotal movement about a lever axis, the lever including a grip region extending from the lever and an engagement point between the lever axis and the grip region;

wherein the actuator ramp is disposed between the valve and the lever engagement point and movement of the grip region toward the vessel axis pivots the lever engagement point into contact with the actuator ramp second surface thereby moving the actuator first surface into contact with the valve to displace the valve along the vessel axis from the closed position.

18. The dispenser according to claim 17, wherein the lever axis is on one side of the vessel axis and the grip region is on an opposing side of the vessel axis.

* * * * *